United States Patent [19]

Chiang

[11] Patent Number: 4,813,470

[45] Date of Patent: Mar. 21, 1989

[54] CASTING TURBINE COMPONENTS WITH INTEGRAL AIRFOILS

[75] Inventor: Feng Chiang, Cypress, Calif.

[73] Assignee: Allied-Signal Inc., Morris Township, Morris County, N.J.

[21] Appl. No.: 118,112

[22] Filed: Nov. 5, 1987

[51] Int. Cl.[4] ..... B22D 27/04

[52] U.S. Cl. ..... 164/122.1; 164/125; 164/127; 164/338.1; 164/352; 164/361

[58] Field of Search ..... 164/122.1, 122.2, 122, 164/125, 127, 338.1, 352, 361

[56] References Cited

U.S. PATENT DOCUMENTS

| | | | |
|---|---|---|---|
| 3,248,764 | 5/1966 | Chandley | 164/127 |
| 3,260,505 | 7/1966 | VerSnyder | 164/122.1 X |
| 3,283,377 | 11/1966 | Chandley | 164/361 X |
| 3,312,449 | 4/1967 | Chandley . | |
| 3,342,455 | 9/1967 | Fleck et al. | 164/125 X |
| 3,376,915 | 4/1968 | Chandley | 164/122.1 X |
| 3,572,419 | 3/1971 | Barrow et al. | 164/122.2 |
| 3,598,169 | 8/1971 | Copley et al. | 164/122.1 |
| 3,598,172 | 8/1971 | Copley et al. | 164/122.1 X |
| 3,614,976 | 10/1971 | Bolling et al. | 164/122 |
| 3,680,625 | 8/1972 | Hein et al. | 164/122.1 X |
| 3,714,977 | 2/1973 | Terkelsen | 164/122.1 |
| 3,741,821 | 6/1973 | Athey et al. . | |
| 4,240,495 | 12/1980 | Vonnegut | 164/125 |
| 4,436,485 | 3/1984 | Vonnegut | 164/122.1 X |

FOREIGN PATENT DOCUMENTS

| | | | |
|---|---|---|---|
| 0104794 | 4/1984 | European Pat. Off. | 164/122.1 |
| 582055 | 12/1977 | U.S.S.R. | 164/125 |

*Primary Examiner*—Nicholas P. Godici
*Assistant Examiner*—J. Reed Batten, Jr.
*Attorney, Agent, or Firm*—R. Steven Linne; James W. McFarland

[57] ABSTRACT

Method and apparatus for controlling radial solidification in cast turbine wheel or nozzle assembly so as to produce an equiaxed fine grain structure in a hub portion and a directionally solidified grain structure in an integral blade portion by means of adjustable heat shields and heating elements disposed above and below the mold.

29 Claims, 4 Drawing Sheets

CASTING TURBINE COMPONENTS WITH INTEGRAL AIRFOILS

TECHNICAL FIELD

This invention falls broadly in the field of metal founding and, more particularly, relates to controlling solidification of a cast turbine wheel or nozzle assembly so as to produce an equiaxed fine grain structure in a hub portion and a directionally solidified or single crystal grain structure in an integral blade or airfoil portion extending therefrom.

BACKGROUND ART

One of the limiting factors in the design of high performance gas turbine engines is the ability of the turbine wheel or nozzle assembly to withstand the severe conditions of temperature and stress which exist during operation of the engine.

Turbine wheels and nozzles are located immediately downstream from the combustion area of an engine and must operate in an environment of high temperature corrosive gases. In addition, the turbine wheels operate under great mechanical stress due to their very high rotational speeds—often exceeding 100,000 revolutions per minute.

In the past, it has been generally known to cast turbine wheel assemblies in one piece. See, for example, U.S. Pat. Nos. 3,283,377 and 3,312,449. However, even though special care was taken to produce high quality, fine grained hub castings, defects initiated in the airfoil portion often led to failures.

One way to reduce failures is to forge the wheel hub or disk from a high strength alloy and then mechanically attach individual blades to it. The individual blades can be cast with high precision and inspected for quality before assembly thus reducing the probability of a defect in the wheel. In addition, such small castings may be directionally solidified in a columnar grain structure or even solidified as a single crystal to further improve their high temperature properties. See, for example, U.S. Pat. Nos. 3,342,455: 3,680,625; 3,714,977; 3,260,505 and 3,376,915.

However, this two-stage process is very expensive and time consuming; so attempts have been made to achieve the improved blade structure in an integral casting. U.S. Pat. No. 3,614,976 suggests that rotation of a casting mold during solidification can result in columnar grained blades and equiaxed fine grains in the hub of turbine wheels. A different approach is suggested by U.S. Pat. No. 3,741,821 wherein a forged wheel assembly (having an all equiaxed grain structure) is heat treated only in the blade region to allow those grains to grow into a larger and/or columnar structure.

More recently, attempts have been made to more accurately control the solidification of a cast wheel assembly to produce the desired dual macrostructures. See, for example, U.S. Pat. Nos. 3,283,377; 3,312,449; 3,598,169; 4,240,495 and 4,436,485.

A major disadvantage of these prior art processes is that it is still very difficult to precisely control the thermal gradients in the mold, and thus the solidification process, to achieve the desired microstructure in the as-cast turbine wheel.

It is, therefore, an object of the present invention to provide an improved method and apparatus for controlling the solidification of a cast disk-shaped component.

SUMMARY OF THE INVENTION

The present invention aims to overcome the disadvantages of the prior art as well as offer certain other advantages by providing a novel casting system which incorporates a disk-shaped mold having a heat sink adjacent the periphery and a combination of thermal emitters and thermal shields adjacent the top and bottom side surfaces of the mold.

The mold is basically a conventional thin walled investment shell mold made by dip coating a wax pattern with several layers of ceramic. After drying, the wax is removed and the cavity prepared to receive molten metal.

The peripheral heat sink is generally a ring-shaped water-cooled metal chill block located adjacent the blade portion of the mold. Its function is to ensure that heat is withdrawn from the mold in only a radial direction thus promoting directional solidification toward the center of the mold.

The thermal emitters are generally electric resistant heating elements arranged preferably in several concentric circles about the axis of the mold but in planes spaced apart from the top and bottom sides. Each circular heating element may be individually controlled to provide a precise amount of heat to the adjacent mold surface. Alternately, one continuous element may be arranged in a spiral path or a round planar heating element can be used, if precise control of the heat input is not required.

Movable thermal shields are arranged between the heating element and the mold so as to provide a means for accurately controlling the amount and location of heat added or withdrawn from the mold. The shields are preferably constructed like an iris diaphragm in a camera shutter so that the area of the central aperture can be adjusted to allow more or less radiant energy to pass to or be withdrawn from the mold as desired. The shields may be water cooled for protection from the heat and/or for use as an auxiliary heat sink.

During operation of the casting system, molten metal is poured into the preheated mold and allowed to solidify under conditions carefully controlled by the combined actions of the chill block, heating elements, and heat shields. Preferably, the actions of these elements are controlled by a computer or other automatic control means so that the process is consistently repeatable from one batch of castings to the next and the desired structure easily achieved.

The presence of columnar zones in castings has been recognized for some time, but until recently, this type of structure was considered a defect and not nearly so desirable as the equiaxed structure. In recent years, however, the properties of columnar structures have undergone re-examination and it has now been determined that in some applications, the columnar structures are markedly superior to equiaxed structures. For example, it has been found that the high temperature properties of columnar structures are superior, particularly in fracture resistance and ductility under creep loading conditions.

Columnar structures are formed by the unidirectional growth of dendrites during solidification. The relationship between the dendritic structure and the columnar grains is not exact. Each columnar grain is usually composed of more than one dendrite, and the number may vary from a few to several hundred. The interdendritic spacing is related to the solidification rate only. Columnar grain size, however, may be affected by factors other than the solidification process, such as ordinary grain growth.

Basically, the process of the present invention involves balancing the heat flow from the molten metal to ensure that solidification proceeds unidirectionally, at a controlled rate, from the outermost edge of the blades inwardly towards the hub. Initially the heating elements are on and the heat shields fully opened, supplying heat to the entire mold to prevent any loss of heat from the top or bottom of the mold. After solidification begins on or near the chill block, the heat shields are slowly closed and the outer heating elements turned off. As the solidification front is moved inwardly, the heat shields are progressively closed and additional heating elements deenergized. This slow, controlled radial solidification results in directional solidification or even single crystal grain growth in the outermost blade region of the mold. Finally, all the heating elements are extinguished and the heat shields fully opened to more rapidly cool the hub region and form a fine, equiaxed grain structure. A further grain refining process, e.g., agitation or spinning of the mold, may then be performed, if desired.

BRIEF DESCRIPTION OF THE DRAWINGS

While the specification concludes with claims particularly pointing out and distinctly claiming the subject matter which is regarded as the invention, it is believed that the objects, advantages, and features thereof may be better understood from the following detailed description of a presently preferred embodiment when taken in view of the accompanying drawings in which:

BEST MODE FOR CARRYING OUT THE INVENTION

Figure 1B:
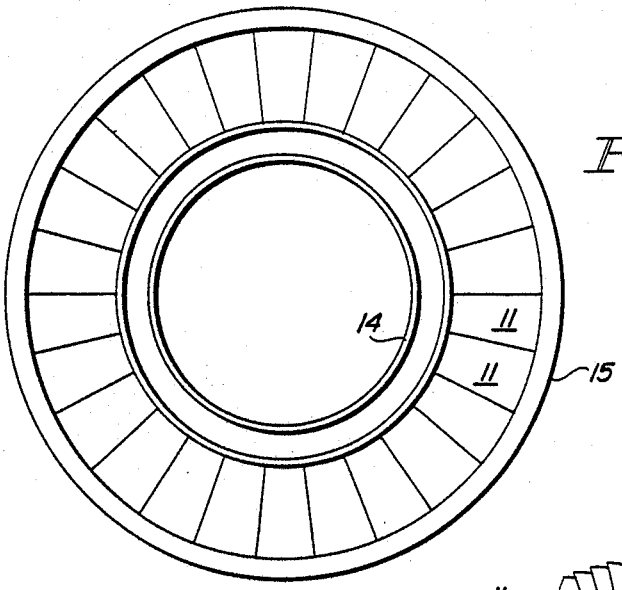
FIGS. 1A, 1B and 1C illustrate three types of turbine components having integrally cast blades extending radially outwardly from a hub.
Figure 1A:
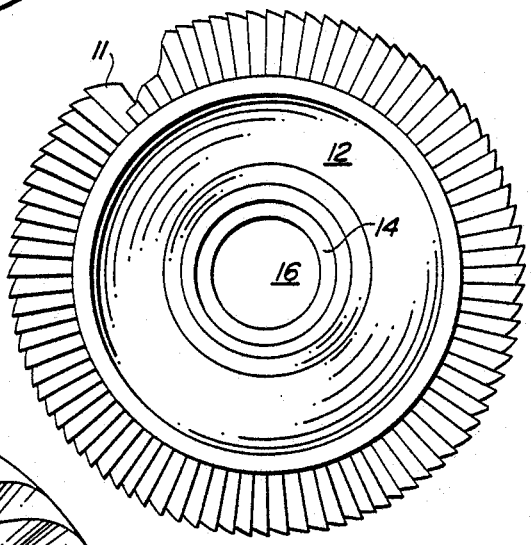
Figure 1C:
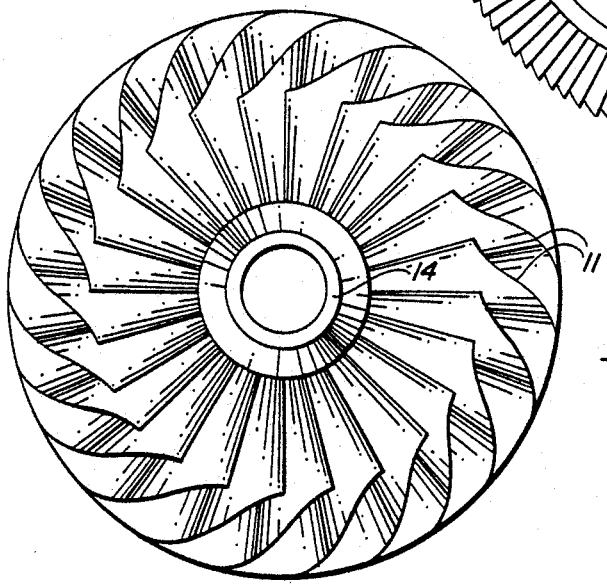

FIG. 1A illustrates one type of cast turbine wheel produced by the method and apparatus of the present invention. Airfoil shaped blades (11), having a directionally solidified and/or single crystal microstructure, extend from the periphery of a disk (12) which has an equiaxed grain structure. Typically the disk (12) is provided with a hub (14) containing an aperture (16) for fitting around a shaft in a turbomachine (not shown). FIG. 1B shows a type of turbine nozzle which has a hub or inner shroud ring section (14), an airfoil blade section (11), and an outer shroud ring (15) joining the periphery of the blades. FIG. 1C shows still another type, a radial flow turbine wheel, which has a relatively thicker hub (14) and blades (11) which reduce in size as they extend outwardly from the hub. This invention is, of course, suitable for production of other similar types of turbine components which may vary somewhat in the details of their construction.

Figure 2A:
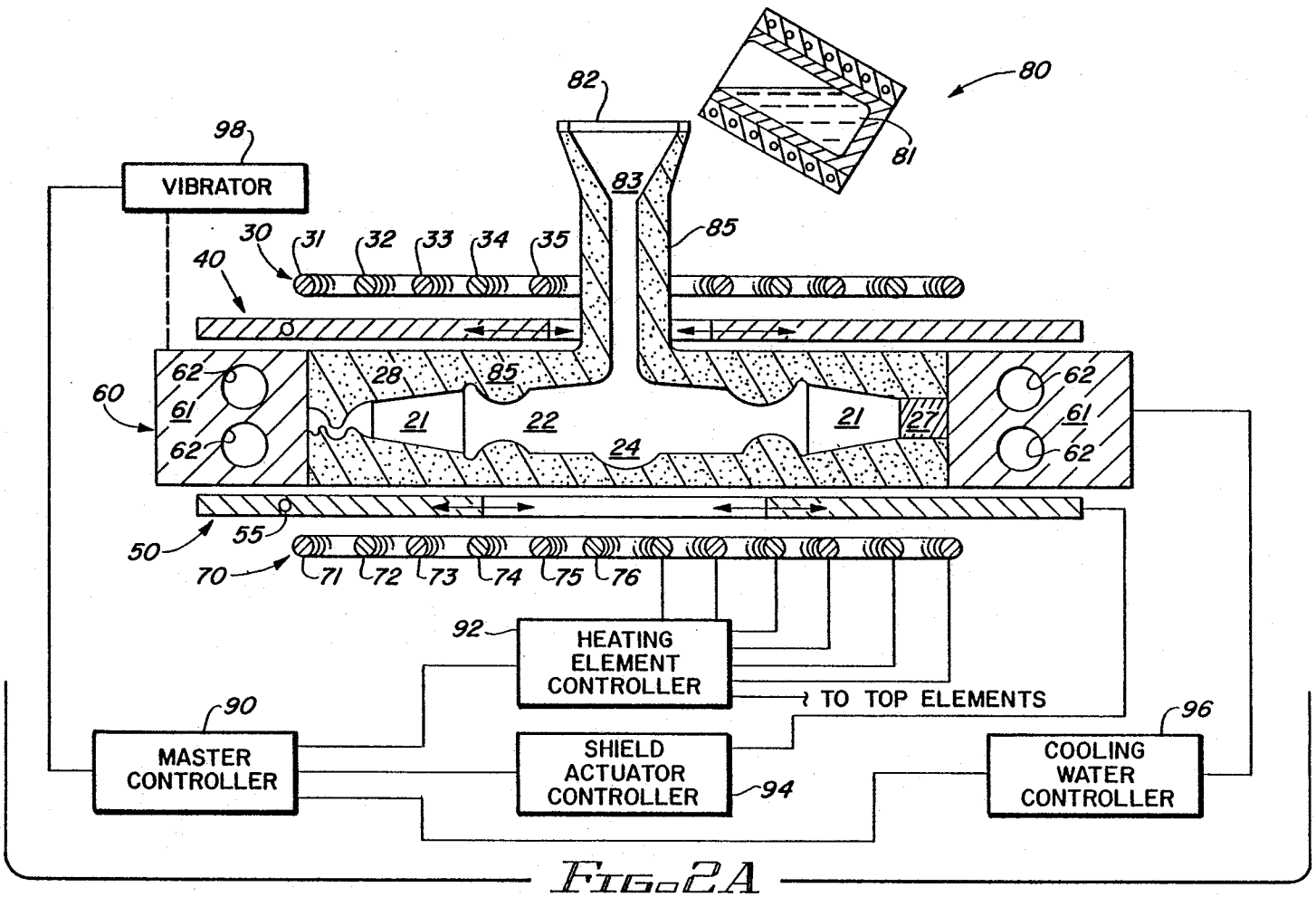
FIGS. 2A, 2B and 2C are cross-sectional schematics showing major elements making up the casting apparatus for producing the three types of components shown in FIG. 1.

FIG. 2A illustrates the major elements of the casting apparatus used to produce the turbine wheel shown in FIG. 1A. A mold assembly (60) generally comprises a ring-shaped chill block (61) surrounding a ceramic shell (85) which is adapted to contain and shape molten metal. Closely adjacent the top and bottom sides of the mold assembly (60) are movable heat shields (40,50) which may be opened or closed to expose more or less of the ceramic shell (85). Outboard from each of the thermal shields (40,50) is an array of heating elements (30,70) which supply heat to the portion of the ceramic shell (85) exposed by the shields (40,50). A process control system (90) is preferably used to monitor and adjust the position of the heat shields (40,50), the amount of heat supplied by the heating elements (30,70), the amount of heat extracted by the chill block (61) or water cooled heat shields, and other system variables.

Figure 2B:
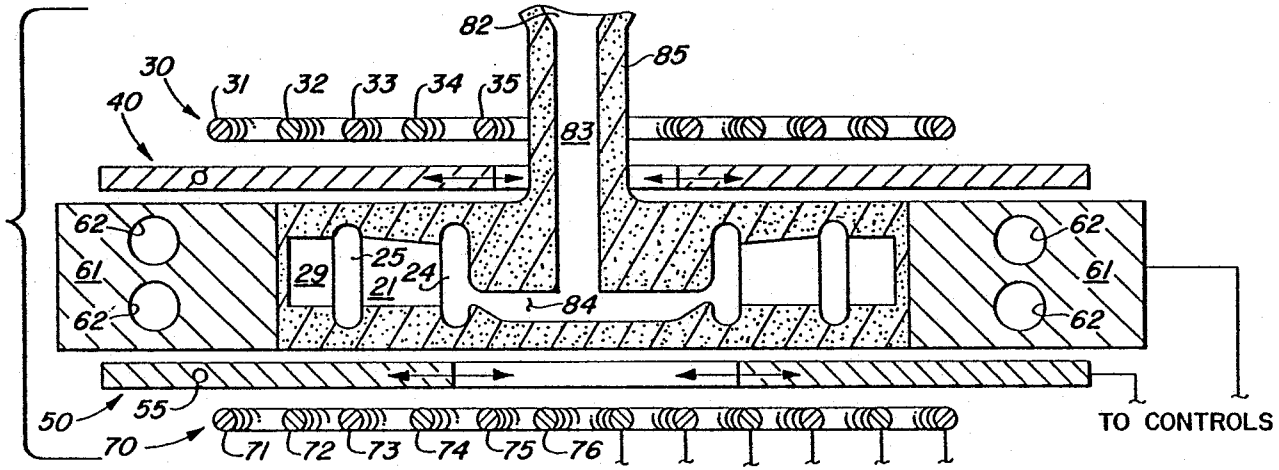
Figure 2C:
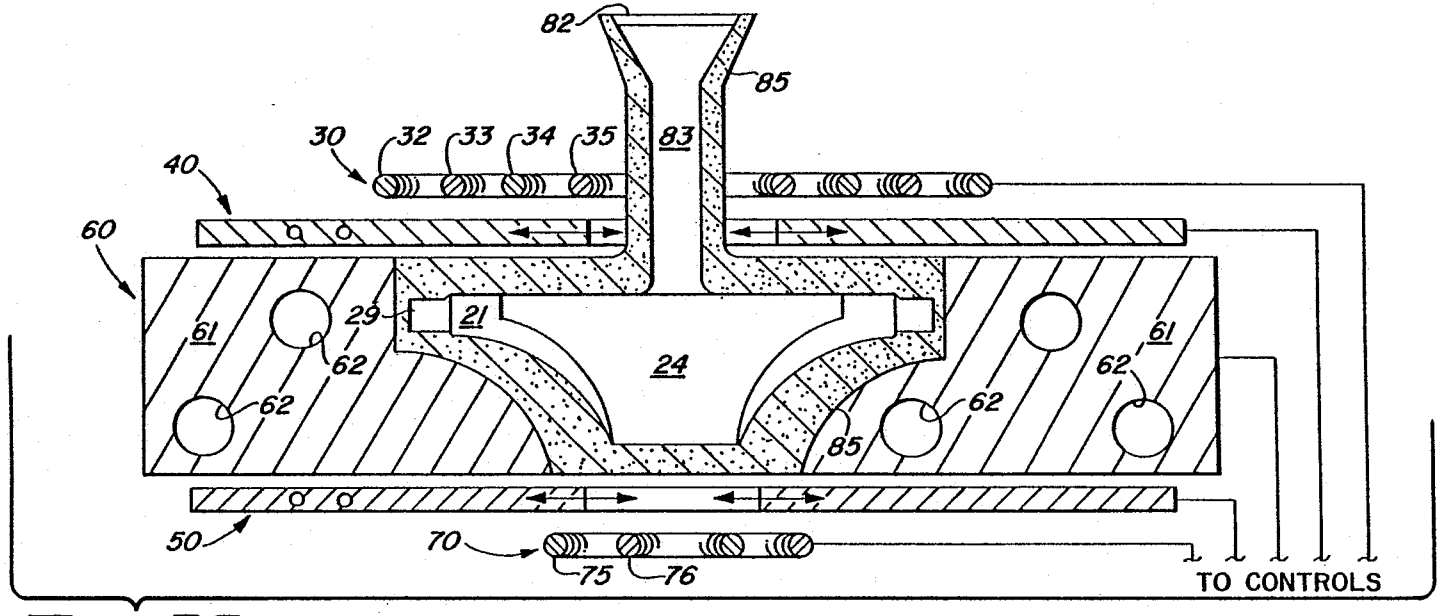

The ceramic shell (85) is formed by well-known methods in which a wax or plastic pattern of the desired wheel (along with the necessary casting sprue and runners) is dipped into a refractory mixture such as colloidal alumina or silica, zircon or alumina sand or other finely divided ceramic. This process is repeated sufficiently to build up several self-supporting layers on the pattern. After the ceramic is dry, the pattern is removed to leave a casting cavity for receiving molten metal. The casting cavity shown in FIG. 2A defines areas for forming the blades (21), disk (22), and hub (24) of the turbine wheel shown in FIG. 1A. It also has a pouring cup (82) and sprue (83) for directing molten metal throughout the cavity. FIG. 2B illustrates a somewhat more complex mold for forming a nozzle of the type shown in FIG. 1B. The casting cavity has runners (84) for directing molten metal from the down sprue (83) into areas defining a hub (24), sometimes called an inner shroud ring, the blades or airfoils (21), and an outer shroud ring (25). FIG. 2C illustrates a mold suitable for forming a radial flow turbine wheel of the type shown in FIG. 1C. The casting cavity has a central portion (24) defining a relatively large hub and edge portions (21) defining the blades.

In each of FIGS. 2A, 2B and 2C, the ceramic shells (85) are surrounded by a circular chill block (61), preferably made from a metal having good thermal conductivity, such as copper, and having internal passageways (62) for cooling water. Between the chill block and the portions of the shell mold which define the turbine components are additional cavities which define a grain starter (29) or, alternately, a single crystal selector (28). The shape and function of these relatively small cavities are well known in the art and serve to initiate the formation of the desired crystal structure in the first to solidify metal. Basically, one type of single crystal selector cavity contains a helical passageway which permits only one of the initially solidified metal grains to grow into the main casting cavity. Alternately, a single crystal may be formed by placing a metal "seed" (27) in the grain starter cavity and promoting its growth into the main cavity. Directionally solidified columnar grains may be promoted in a similar manner.

Figure 4B:
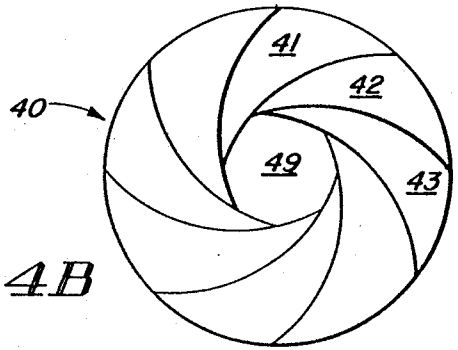
FIGS. 4A and 4B are vertical views of the camera-shutter type heat shield in closed and partially opened positions.
Figure 4A:
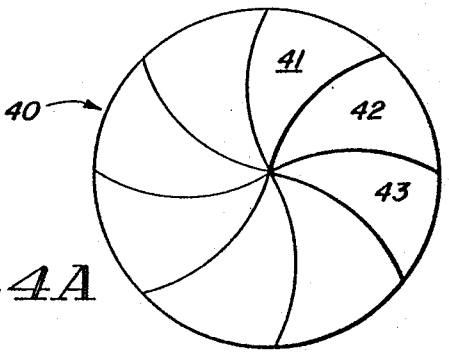

The movable heat shields (40,50) are shown more clearly in FIGS. 4A and 4B. They are preferably formed of several individual elements (41, 42, 43 . . . ) which move in concert with each other to produce a variable size aperture (49) much like an iris shutter in a camera. They preferably are made of heat conducting metal cooled by internal running water or ceramic since they must be closely adjacent the hot mold. On the surface of the heat shield, a thin layer of insulating material, like graphite or carbon-carbon composite can be used to cover the surface that is exposed to the heating elements, so that it is protected from very high temperature. The other side of heat shield should be exposed so that it can absorb the heat from the Just solidified metal and further promote the directional solidification of the unsolidified metal. Their primary function is to control heat transfer from the molten metal in all directions other than radially towards the chill block. They also control the amount and location of heat added to the mold by the overlying heating elements (30,70).

Figure 3B:
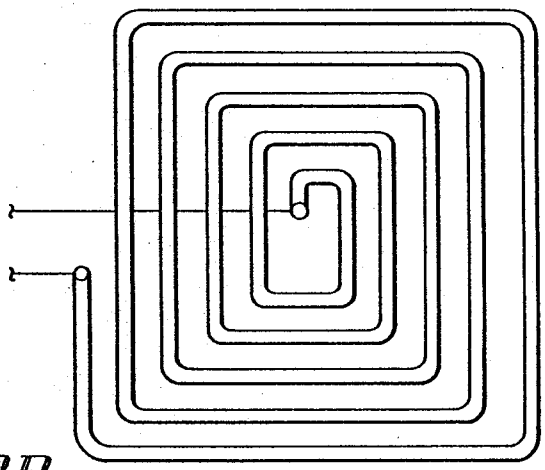
FIGS. 3A and 3B are vertical views illustrating the preferred concentric layout of the heating elements.
Figure 3A:
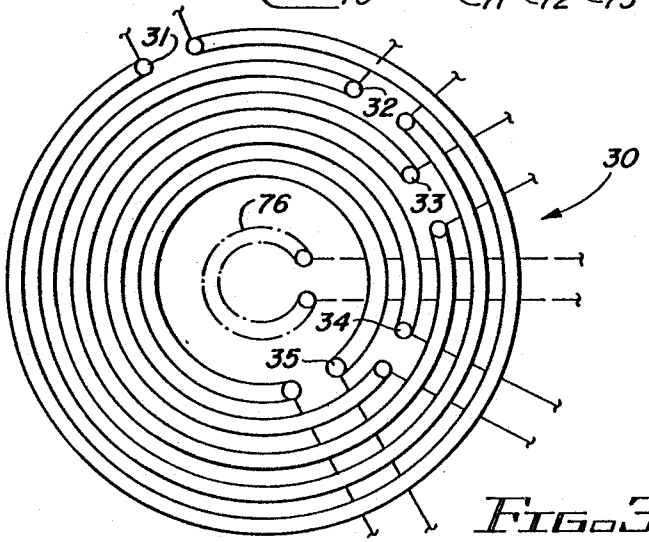

An array of heating elements (30,70) is shown more clearly in FIG. 3A. Each array is preferably compared of several individual elements (31, 32, 33 . . . ) which can be selectively energized in order produce a desired thermal profile in the casting mold assembly (60). Typically, the top array (30) and bottom array (70) are similar unless the mold configuration allows the use of a greater or lesser number of elements. As illustrated in FIG. 2C, the bottom array (70) may sometimes contain only a few elements (75,76). In some cases it would be possible to utilize a unitary spiral shaped element as shown in FIG. 3B since the thermal shields (40,50) can regulate the exact amount of heat delivered to the mold. The heating elements are typically electric resistance heated bars connected to an external power source (92) and controlled by a process control computer (90).

In operation, the ceramic shell (85) is usually preheated to a suitable casting temperature by opening the heat shields (40,50) and energizing the heating elements (30, 70). Preferably, the process control computer (90) senses the temperature of various parts of the mold by, for example, thermocouples or other well known means.

The molten metal (81), typically a nickel base superalloy melted by any suitable device (80), such as an induction power melting unit, is introduced into the mold pouring cup (82), flows down the sprue (83), and is distributed into the mold cavity. Often the entire mold assembly is contained within a vacuum melting furnace to prevent contamination of the molten metal.

Because of the insulating effect of the ceramic shell (85) and the heat input to the top and bottom of the mold from the energized heating elements (30,70), solidification of the molten metal begins in the grain starter cavities adjacent the chill block (61). The chill zone consists of many fine dendrites having a random orientation. The initial freezing releases the heat of fusion, resulting in some temperature rise locally, arresting the chill zone formation. At the interface of the chill zone and the melt, the dendrites begin to grow into the melt at a rate dependent upon the amount and depth of the supercooling.

Initially, all dendrites at the chill zone-melt interface grow at equal rates since equal supercooling is present. However, those oriented parallel to the thermal gradient are growing into an area of continued supercooling. Those oriented unfavorably cannot advance as rapidly in the direction of the thermal gradient, since only a component of the growth velocity is aligned with this gradient. The dendrites growing parallel to the gradient, since they have already undergone some growth, will give off a latent heat of fusion due to the freezing process. This heat of fusion increases the temperature at the base of the dendrites and decreases the amount of supercooling available for growth of the more unfavorably oriented neighbors. In this manner, the growth of the misoriented dendrites is stifled, and only those aligned with the thermal gradient will undergo significant growth.

When single crystal seeds (27) are used within the grain starter cavities (29), the molten metal solidifies on the seeds and grows into the molten metal with the same crystal structure and orientation as the seed. Thus it is possible to preselect the orientation of the grains in the blades by proper selection of the seed crystals as is well known in the art.

These single crystal grains or directionally solidified columnar grains are forced to grow inwardly from the grain starters (29) through the blade region (11) of the casting by maintaining the thermal gradient in the radial plane of the mold. As the solidification front proceeds, the thermal shields.(40,50) are slowly closed and the outermost heating elements (71,72) deenergized. All the heat of fusion is withdrawn from the molten metal through the solidified grains and into the chill block (61) to be carried away by cooling water flowing through passages (62). Also some heat from the already solidified metal may be carried away by the overlying heat shields if it too is water cooled.

After solidification has proceeded into the disk or hub (12) region: of the wheel, an agitation process known for producing fine grain structure castings can be applied to form a fine equiaxed grain structure near the center of the wheel. This may conveniently be accomplished by completely closing the thermal shields (40,50), deenergizing all the heating elements (30,70), and energizing a vibrator (98) connected to the mold. After the heating elements have cooled somewhat, the heat shields (40,50) may be opened to allow thermal radiation to leave the mold and further increase the cooling rate.

While the invention has been described in terms of one preferred embodiment, it is expected that various alternatives, modifications, or permutations thereof will be apparent to those skilled in the art. Accordingly, it is intended that equivalents be embraced within the spirit and scope of the invention as defined by the appended claims.

What is claimed is:

1. Apparatus for casting a turbine component having a central hub with a predominately equiaxed grain structure and radially outwardly extending blades with a predominately directionally solidified grain structure, comprising:

a disk-shaped mold having an interior casting cavity defining said turbine component including portions defining said central hub and said radially outwardly extending blades, a heat sink positioned around the outer periphery of said disk-shaped mold and adjacent said blade defining portion of said casting cavity, a top thermal shield positioned adjacent the top side surface of said disk-shaped mold, and a bottom thermal shield positioned adjacent the bottom side surface of said disk-shaped mold.

2. The apparatus of claim 1 wherein said thermal shields comprise a plurality of movable elements capable of forming a variable diameter aperture concentric with the axis of said disk-shaped mold.

3. The apparatus of claim 2 further including a top thermal emitter positioned above said top thermal shield and a bottom thermal emitter positioned below said bottom thermal shield so that said thermal shields are located between said emitters and said mold.

4. The apparatus of claim 3 wherein said disk-shaped mold and said heat sink lie in a first horizontal plane and said thermal shields and said thermal emitters lie in horizontal planes spaced apart from said first plane but parallel thereto.

5. The apparatus of claim 4 wherein said thermal emitters each comprise a single heating element.

6. The apparatus of claim 4 wherein said thermal emitters comprise a plurality of individually controllable electrically heated elements positioned in a circular array concentric with the axis of said disk-shaped mold.

7. The apparatus of claim 6 further including a process controller means for moving the thermal shield elements in coordination with controlling the individual heating elements so as to produce a radial thermal gradient in said mold.

8. The apparatus of claim 1 further including means for distributing molten metal into said casting cavity, said means including a pouring cup, a vertical sprue, and horizontal runners.

9. The apparatus of claim 1 wherein said mold is a thin wall ceramic shell mold.

10. The apparatus of claim 1 further including means for agitating the mold.

11. The apparatus of claim 1 wherein said turbine component is an axial flow turbine wheel and said casting cavity further includes a portion defining a grain selector located radially outwardly from the blade defining portion of said cavity.

12. The apparatus of claim 11 wherein said grain selector defining portion of the casting cavity is adapted to promote the formation and growth of a single crystal into the blade defining portion of said cavity.

13. The apparatus of claim 12 wherein said grain selector defining portion of the casting cavity includes a helical passageway having one end terminating adjacent said heat sink and the other end terminating in the blade defining portion of the casting cavity.

14. The apparatus of claim 11 wherein said grain selector defining portion of the casting cavity contains a solid seed crystal having one side adjacent said heat sink and another side adjacent the blade defining portion of the casting cavity.

15. The apparatus of claim 1 wherein said turbine component is a nozzle and said casting cavity further includes a portion defining an outer shroud ring located radially outwardly from the blade defining portion of said cavity.

16. The apparatus of claim 15 wherein said heat sink is a water cooled metal chill block in contact with the outer shroud ring defining portion of the casting cavity.

17. The apparatus of claim 15 wherein said casting cavity further includes a portion defining a grain selector located radially outwardly from the outer shroud defining portion of the cavity and lying in the plane of the blade defining portion of the cavity.

18. The apparatus of claim 17 wherein said grain selector defining portion of the casting cavity is adapted to promote the formation and growth of a single crystal through said outer shroud defining portion of said cavity and into the blade defining portion of said cavity.

19. The apparatus of claim 18 wherein said grain selector defining portion of the casting cavity includes a helical passageway having one end terminating adjacent said heat sink and the other end terminating in the outer shroud defining portion of the cavity adjacent and the blade defining portion of the casting cavity.

20. The apparatus of claim 17 wherein said grain selector defining portion of the casting cavity contains a solid seed crystal having one side adjacent said heat sink and another side in contact with the outer shroud defining portion of the cavity and adjacent the blade defining portion of the casting cavity.

21. The apparatus of claim 1 wherein said turbine component is a radial flow turbine wheel and said heat sink is a water cooled metal chill block in contact with the blade defining portion of the casting cavity.

22. A method of making a cast metal turbine component of the type having a central disk with integrally formed blades extending radially therefrom and lying generally in the plane of the disk, comprising the steps of:

providing a disk-shaped mold having an interior casting cavity defining said turbine component, a cooled metal heat sink adjacent the periphery of said cavity, and heat shields adjacent the top and bottom side surfaces of the mold, casting molten metal into said mold, extracting heat from said molten metal through the peripheral heat sink while preventing substantial loss of heat from the top and bottom side surfaces of the mold, by utilizing said heat shields thereby forming a radial thermal gradient in said molten metal, and causing said molten metal to directionally solidify radially inwardly from said heat sink to form a columnar grain structure in at least the blade portion of the turbine component.

23. The method of claim 22 further including the steps of moving the heat shields after the blade portion has solidified, increasing the cooling rate of the remaining molten metal, and forming an equiaxed grain structure in at least the central portion of the turbine component.

24. The method of claim 23 further including the steps of providing an array of individually controllable heating elements positioned adjacent said heat shields and controlling said heating elements during solidification to enhance the radial thermal gradient in the molten metal.

25. The method of claim 24 further including the step of agitating the mold so as to promote the formation of a fine equiaxed grain structure in the last to solidify molten metal.

26. The method of claim 22 further including the steps of providing single crystal seeds within said mold located in contact with said heat sink and extending into said casting cavity, flowing said molten metal into contact with said single crystal seeds, causing said molten metal to begin to solidify on the surface of said seeds and then grow in the form of a single crystal into the molten metal filled casting cavity by extracting heat from the molten metal in a radial direction through the solidifying single crystal and into said heat sink.

27. The method of claim 26 further including the steps of waiting until the single crystal seeds have grown the portion of the casting cavity which defines the blades of the turbine component and then interrupting the further growth of the single crystals while promoting the formation of equiaxed grains in the remaining molten metal.

28. The method of claim 27 wherein the steps of interrupting and promoting include the step of agitating the mold.

29. A method of casting a one-piece metal turbine wheel having a cylindrical hub and a plurality of integral radially extending blades, the metallurgical structure of said hub being characterized by predominately equiaxed grains and that of said blades being predominately radially aligned columnar grains, comprising the steps of:

providing a mold having a disk-shaped casting cavity defining said hub and said blades, and also having a heat sink adjacent the periphery of said cavity, movable thermal shields adjacent the top and bottom of said cavity, and thermal emitters adjacent said thermal shields;

casting molten nickel base superalloy metal into said cavity:

extracting heat from said molten metal in a radially outwardly direction into said peripheral heat sink while initially inhibiting heat flow in all other directions;

solidifying the molten metal within the blade defining portion of said cavity to form a radially aligned columnar grain structure;

moving said thermal shields; and cooling the molten metal within said hub defining portion of said cavity to promote the solidification of an equiaxed grain structure.

* * * * *